United States Patent [19]

Henry

[11] 4,402,192

[45] Sep. 6, 1983

[54] REFRIGERATED DISPLAY CASE HAVING AN ACCORDION-TYPE COMBINED AIR DUCT AND SERVICE DOOR

[75] Inventor: James Henry, Levittown, Pa.

[73] Assignee: Emhart Industries, Inc., Farmington, Conn.

[21] Appl. No.: 336,144

[22] Filed: Dec. 31, 1981

[51] Int. Cl.[3] ..... A47F 3/04

[52] U.S. Cl. ..... 62/256; 160/84 R

[58] Field of Search ..... 62/237, 255, 256, 257, 62/253, 258, 259, 260, 246, 249; 98/33 R; 160/84

[56] References Cited

U.S. PATENT DOCUMENTS

| | | | |
|---|---|---|---|
| 3,021,691 | 2/1962 | Jacobs | 62/256 |
| 3,063,255 | 11/1962 | Fanick, Jr. | 62/256 |
| 4,019,554 | 4/1977 | Rasmussen | 160/84 R |
| 4,034,572 | 7/1977 | Morris et al. | 62/256 |
| 4,275,645 | 6/1981 | Ruff | 62/256 X |

FOREIGN PATENT DOCUMENTS

| | | |
|---|---|---|
| 2448896 | 4/1976 | Fed. Rep. of Germany . |
| 2038670 | 1/1971 | France . |

*Primary Examiner*—Lloyd L. King

*Attorney, Agent, or Firm*—Frederick A. Zoda; John J. Kane

[57] ABSTRACT

A refrigerated display case, of the type in which air flows through a duct and is circulated about a product display space, has a service opening at the rear of the case. Disclosed is an accordion-pleated, hollow wall structure which is both an air duct and a door. The structure in its closed position communicates at top and bottom with adjacent portions of the conduit through which air is circulated during refrigeration or, in some instances, during defrost cycles of the case. In its open position, the hollow structure defines a service opening at the rear of the case through which dairy product support carts can be rolled into or out of the case. The hollow structure is sectionally formed in a manner to define the service opening at any selected cart location.

14 Claims, 10 Drawing Figures

REFRIGERATED DISPLAY CASE HAVING AN ACCORDION-TYPE COMBINED AIR DUCT AND SERVICE DOOR

BACKGROUND OF THE INVENTION

1. Field of the Invention

The present invention relates generally to refrigeration, and in a more particular sense has reference to those structures in the refrigeration category described commercially as refrigerated display cases. Such cases are of the type used in food markets, and within this general category the invention comes within the field of invention wherein the display case has an air passage through which air is circulated about the displayed food products, often flowing as an air curtain across an open front of the display case. In yet a more particular sense, the invention has reference to improvements in this type of display case, wherein a service opening is provided at the rear of the case, through which dairy product support carts may be rolled into and out of the case. The invention relates to a hollow structure normally closing the service opening through which the carts are moved, the structure being both a part of the air flue or conduit, and a foldable door for the service opening.

2. Description of the Prior Art

It has heretofore been proposed to provide, in refrigerated display cases of the type generally described above, service openings at the rear of the display cases, through which dairy product support carts can be rolled into and out of the case. It has been proposed that the carts be left within the case to provide convenient means for displaying the products without the necessity of unloading the same and transferring them to shelves such as are normally provided in refrigerated display cases.

It has further been suggested to provide, for the service openings of the cases, closures that serve as air passages communicating with other portions of the air conduit above and below the closures when the closure are in their normal, closed positions.

Usually, closures of this type when used in refrigerated display cases are of the sliding or hinged type. Such doors, unfortunately, present certain problems with respect to rolling carts into and out of the display case.

To appreciate the problems that have arisen, it should first be noted that cases of this type are often of great length, particularly when used in large supermarkets. In such installations, it is common to provide an array of identical display cases, end-to-end, that may extend to an overall length of perhaps 60 to 70 feet, typically.

In such installations, it is desirable that the maximum amount of the total, overall length be available for stocking the displayed food products, that is to say, there should be minimum spacing between the dairy carts, since open spaces between side-by-side carts represent completely wasted, refrigerated areas in the product display space of the display case. Additionally, such open spaces are visually unattractive and detract from the merchandising capability of the case as a means for promoting sales of the displayed products.

Typically, a dairy product support cart, of the type that is rolled into and out of the case to serve as shelving accessible to the customer, is approximately 36" in width. It follows that if the service opening is closed by a series of hinged doors, there would normally be one door for each cart location. That door would have to be of a width that would have a transverse dimension sufficiently greater than the cart width to permit clearance on both sides of the cart when it is moved through the service opening defined by opening of the door. Further, between adjacent doors mullions must be provided if the doors are hinged, of sufficient width and strength to support the doors when they are swung to open positions.

If follows that in such arrangements, substantial open spaces occur between adjacent carts when the carts are in position within the display cases.

The disadvantages of using hinged doors, whether or not they also provide air ducts when in their closed positions, can thus be readily noted when their use is contemplated for dairy cases into which product support carts are to be loaded.

The same problems arise with respect to sliding closures. Whether or not these are hollowly formed to define air ducts in their closed positions, they share with hinged doors the problem that they of necessity leave open spaces between adjacent carts within the display case, a highly undesirable feature which, as noted above, not only detracts from the merchandising ability of the equipment, but also reduces its overall, effective length as a product display area.

It has in fact been proposed to provide foldable flexible closures for the rear surface openings of display cases of the type described, as shown in U.S. Pat. No. 4,034,572, issued July 12, 1977 to the assignee of the present application. While to some extent these facilitate the positioning of carts directly side-by-side with minimum open areas between them, they at the same time take away from the available duct space at the rear of the case. It is desirable, in this connection, that the duct be continuous from end-to-end of the case, so as to provide for uniform refrigeration and an efficient air curtain across the front access opening of the display case.

SUMMARY OF THE INVENTION

The present invention aims to eliminate the deficiencies of the prior art, in the described type of refrigerated display case. To this end, there is provided a case which, over its entire length, has a service opening closed by a plurality of side-by-side, contacting combined duct-and-door sections. These, in the fully closed positions thereof, completely close the back of the case, but at the same time provide continuous ducting over the entire length of the case, disposed in full communication with the top and bottom duct portions conventionally provided therein. The sections are identically formed, each including flexible, accordion-pleated walls, transversely spaced apart and connected to define a duct means when the sections are in their extended, closed positions. The sections, when folded to open positions, expose any selected cart location, leaving ample clearance for movement of a cart into or out of the case, while at the same time being adapted to permit carts to be positioned a minimum distance apart, almost in contact with one another, thereby to make maximum use of the refrigerated product display space.

The accordion combination duct and door sections are all mounted rollably in upper and lower trackways, which themselves are ported to provide the desired communication between the ducts defined by the sections, and the adjacent air passages provided in the fixed upper and lower portions of the display case.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DESCRIPTION OF THE PREFERRED EMBODIMENT

Figure 1:
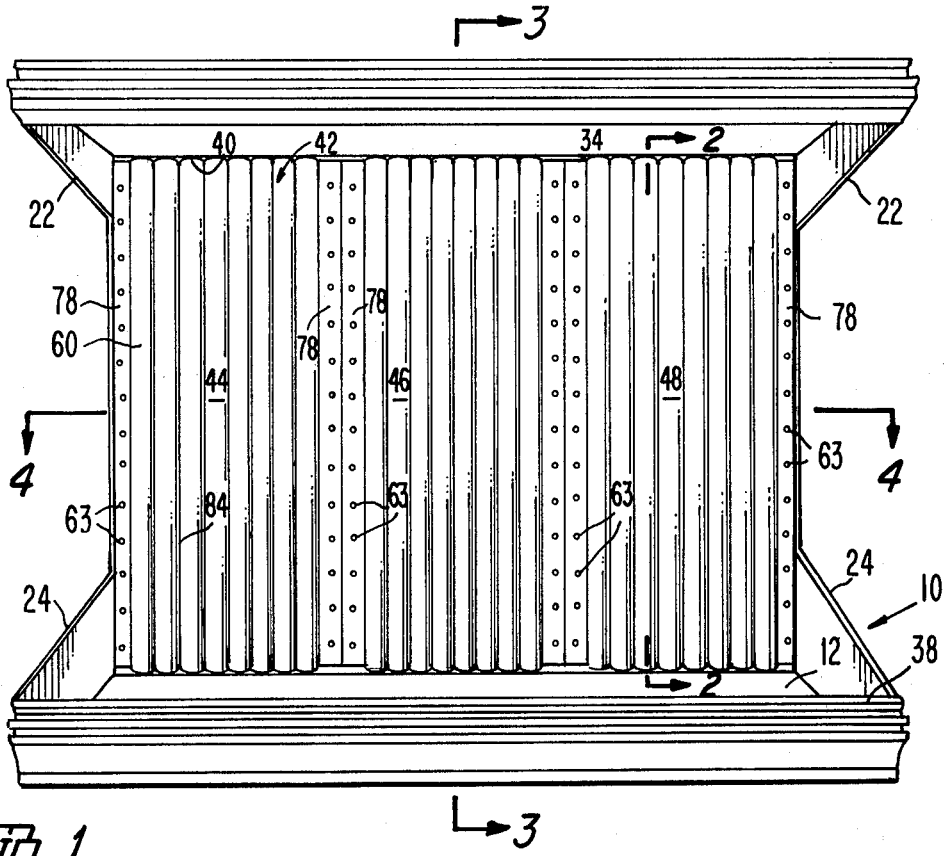
FIG. 1 is a front perspective view of a display case according to the present invention, the accordion sections being in their extended, closed positions.

In the form of the invention illustrated in FIGS. 1-7, the refrigerated display case 10 constituting the present invention includes (FIGS. 1 and 3) a flat base plate 12 flush with the store floor F, overlying a recess 14 formed in the floor to define therebetween a bottom duct portion 16 having near the front of the case an inlet grille 17. Case 10 includes a vertical, insulated back wall 18 rigid at its upper end with a forwardly projecting, insulated top wall 20. At the ends of the case (FIG. 1) upper end walls 22 serve to rigidify the structure and at the same time close the air ducting of the case at its end. Similarly, lower end walls 24 are provided at the ends of the case to discharge a similar purpose. Extending the full length of the case between walls 22 is a plenum wall 26 inclined upwardly from the rear to the front of the case to define, in cooperation with top wall 20, a plenum 28 in which is mounted evaporator coil 30 through which air is circulated by primary fan 32. The case may also be provided with an upper front panel 34 cooperating with a forwardly declining extension 35 of wall 20 to define an ambient air chamber in which is mounted ambient air circulation fan 36 adapted to provide a protective curtain of ambient air in front of the curtain of refrigerated air discharged through nozzle 27 provided at the front of the plenum.

A lower front panel 38 mounted forwardly of inlet 17 aids in channeling the refrigerated air into the inlet 17 after it passes downwardly across the customer access opening 39 located at the front of the case.

The construction so far described is conventional, in that the components so far described are similar in structure and function to corresponding components disclosed in the above mentioned U.S. Pat. No. 4,034,572.

In accordance with the invention, the back wall 18 is open for the full distance between the end walls of the case as shown at 40, fully from the floor to a height sufficient to permit a dairy product support cart C (see FIG. 3) to be moved into and out of the case over a sill 41 extending along the bottom edge of the open back 40, flush with floor F.

Normally closing the open back 40 over its full length and height is a foldable combination duct-and-door structure generally designated 42. In the illustrated example, this comprises three identically constructed, abutting, individually openable sections 44, 46, 48 respectively. Obviously, there can be any number of sections, according to the length of the particular case as ordered by the operators of the food market.

The several sections are mounted rollably in upper and lower trackways common to all of the sections. The upper trackway (see FIG. 2) includes a downwardly opening channeled, upper track member 50 extending the full length of the case. Fixedly secured to and depending from the track member 50, and co-extensive in length therewith, is an upper track element 52 also formed as a channel member and opening laterally to receive upper rollers 54 of the several sections 44, 46, 48.

Figure 10:
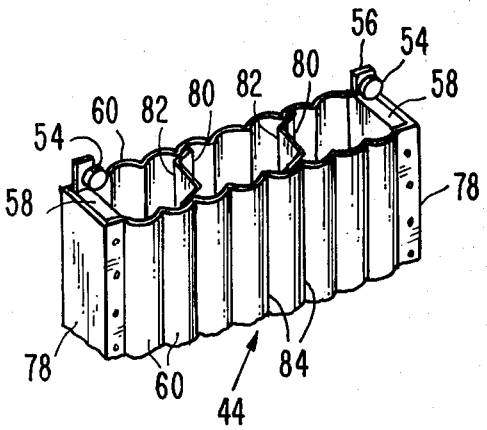
FIG. 10 is a fragmentary perspective view of one of the accordion wall sections.

The description of one of the sections will suffice for all. Each section, thus, includes a plurality of the upper rollers 54, mounted upon angular upper roller brackets 56 welded or otherwise fixedly secured to upper cross members 58. In a typical embodiment, the rollers could be provided as shown in FIG. 10, at the ends of their associated section, with the cross members 58 being disposed at the ends, and being fixedly secured to facing, channeled end walls 78 of the associated section.

Each section further includes transversely spaced flexible sidewalls 60 which may be formed of a rugged, heavy, flexible plastic material impervious to the passage of air therethrough and strengthened by a strong cloth backing, in a preferred embodiment.

At the lower end of each section, lower cross members 62 formed to the same width as the members 58, are fixedly secured to the respective end walls 78 of the section in the same manner as the cross members 58. The flexible walls 60, it may be noted, are secured to the respective end walls 78 by rivets 63 or equivalent fasteners, spaced uniformly apart over the full height of the wall structure (see FIG. 1).

Depending from the respective lower cross members 62 (FIG. 2) are lower roller support posts 64, each of which supports a pair of lower rollers 66, rollably engaged with confronting lower track elements 68 of right angular cross-section, welded or otherwise fixedly secured to the opposite sidewalls of an upwardly opening channel 70 integrally formed in and extending longitudinally and centrally of a lower track member 72. Over the full length of the channel 70, there are formed, both in the sidewalls and in the web of the channel, air inlet ports 74 communicating with the bottom duct portion 16, so that air flowing through said duct portion 16 in the direction of the arrows shown in FIGS. 2 and 3 will be directed upwardly through the rear duct portion 75 defined between the sidewalls 60 of each section.

In the web portion of the upper track member 50, there is formed a series of uniformly spaced outlet ports 76, these being spaced longitudinally of the upper track member so as to occur over the full length of the case. Air exiting from the upper end of the sectional, foldable, back wall 42 passes through the ports 76 into the plenum 28, to be recirculated through the display case.

As previously noted, each section is closed at its ends by end walls 78. The end walls 78 of each section are formed as confronting channels, with the flexible walls 60 of the section riveted to the sidewalls of the channels at 63. The channels are of a rigid metal material, to maintain the walls 60 in transversely spaced relation at the ends of each section.

Intermediate the ends of each section, there are provided, at selected intervals, flexible cross tapes 80, and secured thereto are thin but strong, relatively rigid, transversely extending brace plates 82, which maintain the walls in the desired transversely spaced relation at selected locations between the ends of each section. As a result, when each section is fully collapsed or folded, it will fold accordion fashion along crease lines 84 preformed in the flexible material from which the sidewalls 60 are made.

Figure 6:
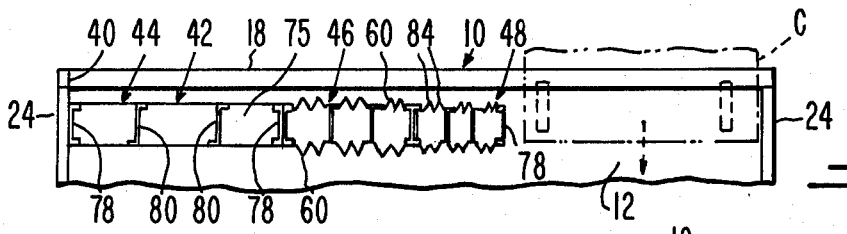
FIG. 6 is a horizontal section on the same cutting plane as FIG. 4, in which the sectional wall structure has been collapsed to permit movement of a cart into a second cart location.
Figure 7:
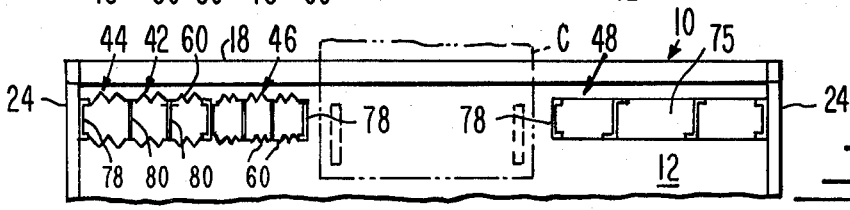
FIG. 7 is a horizontal section on the same cutting plane as FIG. 4, in which the sectional wall has been partially collapsed or folded to permit movement of a cart into a third cart location.
Figure 8:
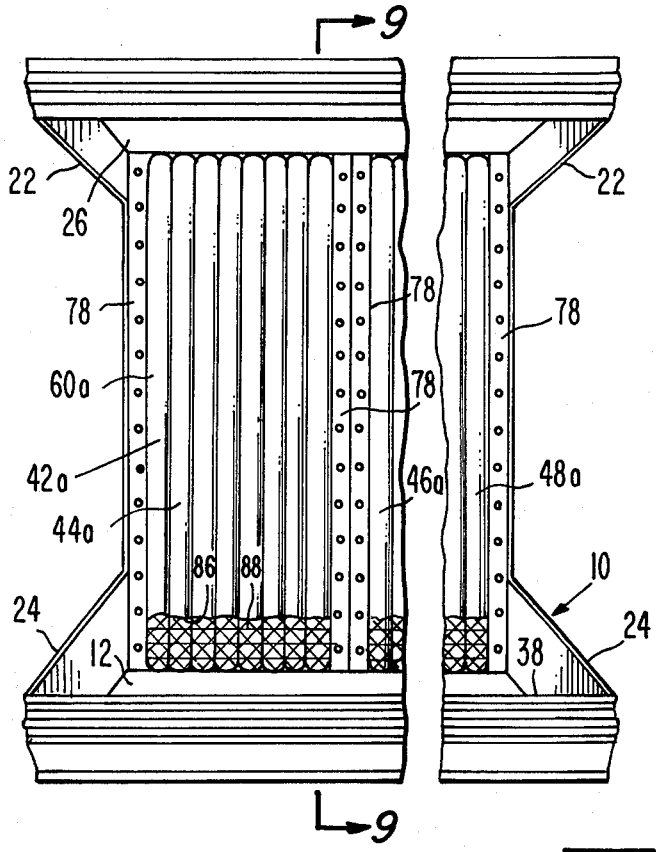
FIG. 8 is a front perspective view, portions being broken away, showing a modified construction.
Figure 9:
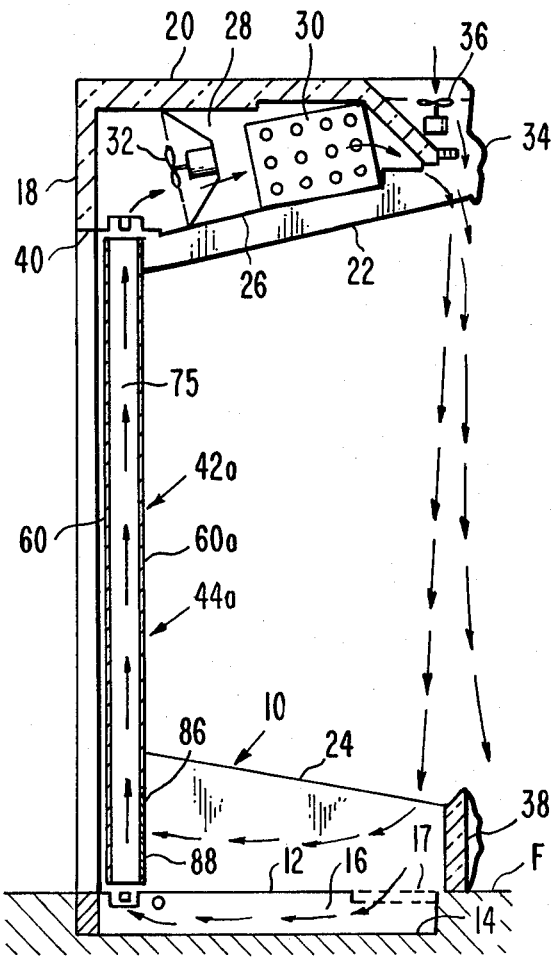
FIG. 9 is a sectional view, substantially on line 9—9 of FIG. 8.

In FIGS. 8 and 9, there is illustrated a refrigerated display case which is identical to that of FIGS. 1–7 in all respects, except for the construction of the accordion wall and a resultant change in the pattern of the air flow when the combined duct and service door is in closed position.

In this form of the invention the flexible closure has been designated 42*a*, and includes sections 44*a*, 46*a*, 48*a*. The description of one section suffices for all. Each section includes a rear flexible wall identical to that in the first form of the invention. Each section includes, however, a forward flexible wall 60*a* which, at its lower end, has its air-impervious material cut away a few inches above the base plate 12 as at 86. The space between the lower extremity of the wall 60*a* and the point 86 at which the air-impervious material thereof terminates is occupied by a foraminous or net material secured to the lower extremity of the non-pervious flexible material of the forward wall, and providing a bottom portion 88 of wall 60*a*, which bottom portion in effect becomes a flexible inlet grille for the rear duct portion 75 when the several sections of the flexible closure are in their closed positions.

In some cases, this is desirable for the purpose of improving the air flow characteristics of the display case, by providing more air at the inlet end of the flexible rear wall, and thereby maintain sufficient volume within the rear duct portion 75. In the illustrated arrangement, the bottom duct portion 16 is still provided, so that there is air flow therethrough as well as across the well of the case above the base plate.

Figure 2:
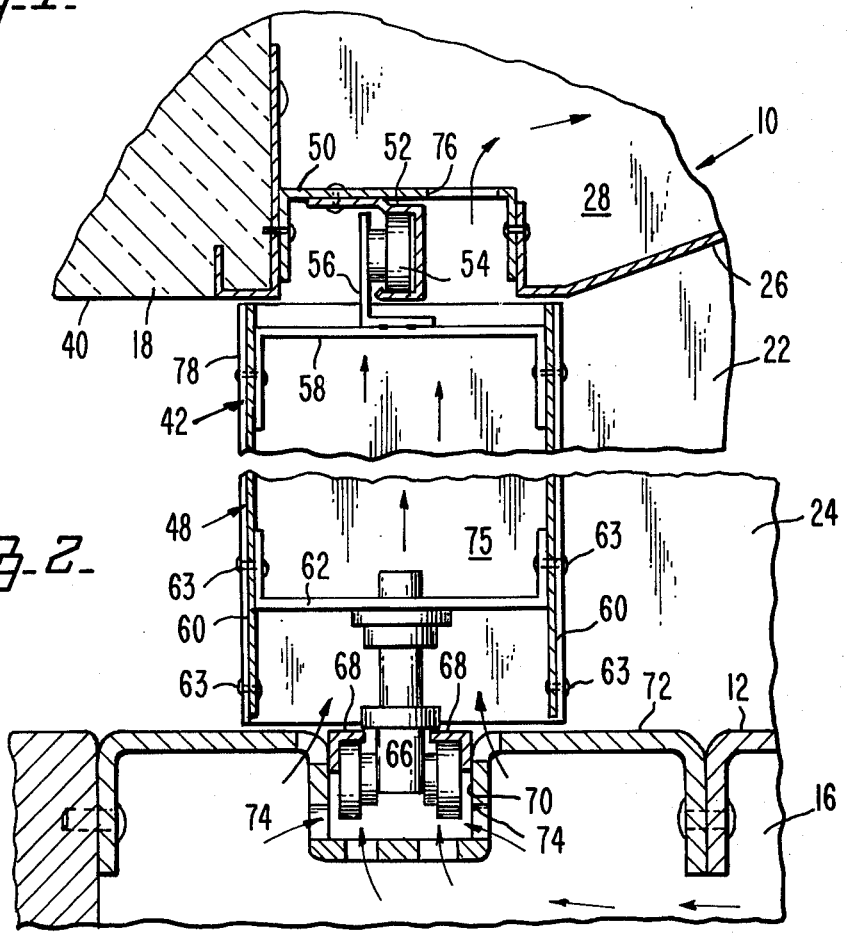
FIG. 2 is a greatly enlarged, fragmentary, transverse sectional view substantially on line 2—2 of FIG. 1.
Figure 3:
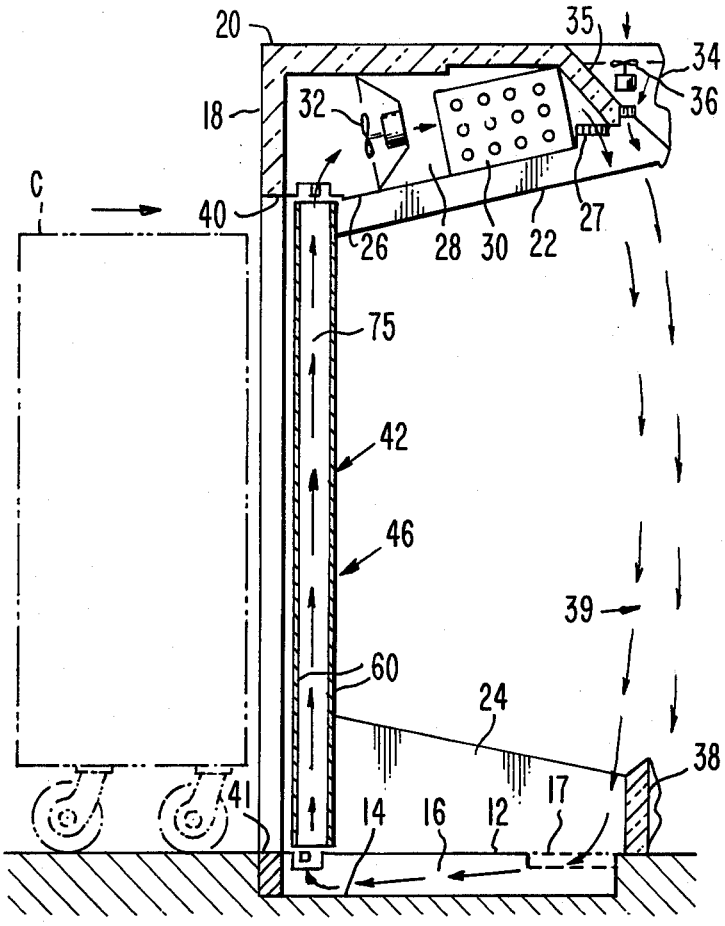
FIG. 3 is a transverse sectional view substantially on line 3—3 of FIG. 1, a dairy product support cart being illustrated in chain-dotted outline as it appears immediately prior to being moved into the case.

Obviously, the construction shown in FIGS. 8 and 9 can be advantageously used, in instances in which it is not desired to form a bottom recess 14 in the floor of the store. The modified construction permits installation of a case directly upon any flat floor surface wherein installation is desired. In these circumstances, there would be no bottom duct portion 16 or floor inlet grille 17. Rather, the base plate 12 would be closed across the entire bottom of the case. Air would enter the lower end of the flexible combined air duct and door through the mesh fabric flexible inlet 88 thereof only. In these circumstances, the lower track member 72 would be made without openings 74, or alternatively, could be made as shown in FIG. 2 with the openings 74 being simply left inoperative due to the omission of the bottom duct portion 16.

Figure 4:
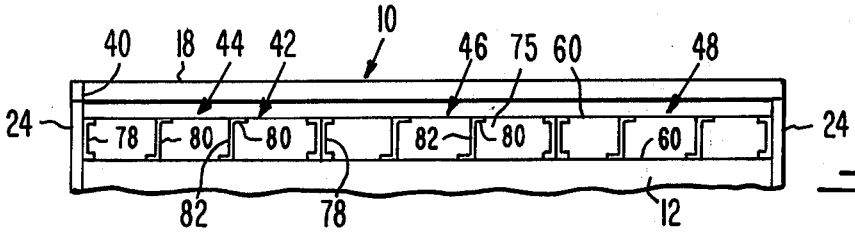
FIG. 4 is a horizontal section substantially on line 4—4 of FIG. 1, with all of the combination duct-and-door sections being in fully extended, closed positions.
Figure 5:
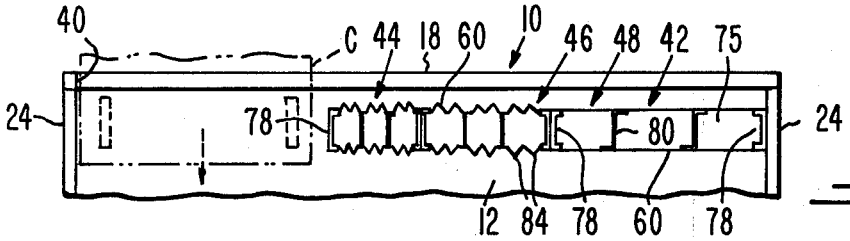
FIG. 5 is a view on the same cutting plane as FIG. 4, in which two of the sections have been folded to permit movement of a cart into one cart location within the case.

In use, and referring particularly to FIGS. 4–7, in all forms of the invention the flexible rear wall can be opened at any cart location desired. In FIG. 4 it is shown in fully closed position. In FIG. 5, it may be assumed that it is desired to roll a cart C into one end of the case. In this event, sections 44, 46 would be folded to whatever extent is necessary to provide clearance for the cart. As soon as the cart is in position, the flexible wall is again closed.

In FIG. 6, a cart C is being moved into the other end of the case. In this event, sections 48, 46 are folded to the extent necessary to provide clearance for the cart.

In FIG. 7, the cart is being moved into a center location. In this instance, sections 44, 46 are folded against one end of the case, to provide an intermediate opening for cart entry.

In every instance, it may be noted that the sections can be opened to whatever degree is necessary to accommodate passage of the cart. Further, the carts can be disposed within the case, in side-by-side relation with minimum clearance space between them, as distinguished from cases provided with sliding or hinged doors. At the same time, as shown in FIG. 4, when the sections are in their extended closed positions they provide a continuous back wall over the entire length of the case, and most importantly, a rear duct portion 75 that is also continuous over the full length of the case and that is of constant transverse and vertical dimensions over its entire area, thus assuring a smooth and uniform air pattern for the entire length of the product display area of the case.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In a refrigerated display case of the air curtain type in which air is continuously recirculated about a product display space, said case having a service opening at its back for stocking the case from the rear, the improvement that comprises a wall structure forming a rear duct portion for the circulated air combined with a rear service door, said wall structure comprising:

(a) a flexible, hollow closure adapted to be folded and extended to open and closed positions respectively, said closure being adapted to close said service opening substantially completely when in its extended position, said closure being formed with open upper and lower ends for the passage of the circulated air therethrough, said closure including at least one pair of vertically disposed, transversely spaced side walls covering the service opening and having a height and width corresponding to the height and width, respectively, of the service opening, the walls of said pair being of a flexible material folded upon itself in a horizontal direction in the open position of the closure, the space between the walls being in communication with said open upper and lower ends of the closure, said walls being spaced apart both in their folded condition and in said extended position of the closure;

(b) a track member fixedly mounted upon the case, said member extending horizontally above the service opening and said walls of the closure; and (c) means engaging the closure with said track member for movement of the closure between said extended and folded positions, said means comprising a plurality of wall suspension elements movably mounted on the track member, said closure being connected to said suspension elements in a depending position within the service opening.

2. In a refrigerated display case the improvement of claim 1 wherein said closure is in the form of abutting unconnected sections selectively foldable to open positions for exposing correspondingly selected areas of the service opening, each section including a pair of said flexible walls and further including a pair of rigid, vertical end walls extending substantially the full height of the service opening and being connected between the flexible walls.

3. In a refrigerated display case the improvement of claim 2, said case being the type into which product support carts may be rolled, in which the sections are foldable to an extent such that the selected, exposed areas overlap whereby to permit said carts to be disposed in side-by-side relation with minimum clearance between adjacent carts, there being at least two unconnected, abutting sections, the flexible walls of both of said sections being at least partially folded in said open position of the closure.

4. In a refrigerated display case the improvement of claim 1, wherein said structure further includes a second track member, said second track member extending horizontally along the service opening below said walls, said means further comprising guide elements movably mounted on the lower track member and connected to the lower end of said closure.

5. In a refrigerated display case the improvement of claim 2, wherein said means comprises rollers individual to each of said sections.

6. In a refrigerated display case the improvement of claim 5 wherein said wall structure further includes a second track member, said second member being extended horizontally along the service opening below said walls, each track member including a channel portion facing toward said closure, said channel portion having ports located in communication with the respective open ends of the closure, said ports constituting entry and exit openings for the circulated air passing through the ends of the closure.

7. In a refrigerated display case the improvement of claim 3 wherein the end walls of each section extend transversely of the section, the flexible side walls of each section being secured to the end walls over the full height of the end walls and being spaced apart by the end walls so as to define said rear duct portion.

8. In a refrigerated display case the improvement of claim 7 wherein each wall section further includes a plurality of transverse spacers secured to and extending across the space between the sidewalls at locations spaced between said end walls and cooperating with the end walls in spacing the sidewalls apart transversely of the wall section at locations between the end walls.

9. In a refrigerated display case the improvement of claim 8 in which the respective sidewalls of each section have uniformly spaced crease lines extending the full height of the side walls, said side walls being folded along the crease line to fold accordion-fashion when the section is operated to open position.

10. In a refrigerated display case the improvement of claim 9 wherein the end walls of each section are disposed in face-to-face contact, over the full height of the section, with the end walls of adjacent sections in the closed position of the flexible closure.

11. In a refrigerated display case the improvement of claim 3 wherein said opening of the case extends fully to the bottom of the case and is defined along its lower edge by a sill, said sill being flush with a floor surface on which the case is supported, whereby to facilitate the rolling of said carts into and out of the case, said closure terminating at its lower end in close proximity to the sill.

12. In a refrigerated display case the improvement of claim 11, said structure further including a second track member extended horizontally below the closure, said means further including guide rollers movably mounted on the second track member and connected to the lower end of the closure, the track member extending below the closure being flushed with said sill.

13. In a refrigerated display case the improvement of claim 12, the track members having ports communicating with the respective open ends of the closure, said ports constituting entry and exit openings for the air circulated through the ends of the closure, the case including a bottom duct below the floor level having an air inlet at floor level at the front of the case and having an outlet defined by the ports of the track member that is mounted in flush relation to the sill.

14. In a refrigerated display case the improvement of claim 1 wherein one of the sidewalls faces interiorly of the case and has a flexible end portion pervious to the passage of air and defining a flexible air inlet grille in said one sidewall.

* * * * *